United States Patent [19]

Meckl et al.

[11] 4,186,007

[45] Jan. 29, 1980

[54] REGENERATION OF SPENT COLOR DEVELOPERS

[75] Inventors: Heinz Meckl, Bergisch-Gladbach; Karl Lohmer, Leverkusen, both of Fed. Rep. of Germany

[73] Assignee: Agfa-Gevaert Aktiengesellschaft, Fed. Rep. of Germany

[21] Appl. No.: 896,937

[22] Filed: Apr. 17, 1978

[30] Foreign Application Priority Data

Apr. 21, 1977 [DE] Fed. Rep. of Germany ..... 2717674

[51] Int. Cl.[2] ..... G03C 5/26; G03C 5/30

[52] U.S. Cl. ..... 430/467; 430/464

[58] Field of Search ..... 96/50 A, 66, 63, 22; 210/39, 24, 27, 38 A, 38 B, 38 R, 37 R

[56] References Cited

U.S. PATENT DOCUMENTS

| | | | |
|---|---|---|---|
| 3,253,920 | 5/1966 | Rees | 96/55 |
| 3,420,709 | 1/1969 | Barrett et al. | 210/39 |
| 3,444,079 | 5/1969 | Bowers | 210/39 |

FOREIGN PATENT DOCUMENTS

| | | | |
|---|---|---|---|
| 2745916 | 4/1978 | Fed. Rep. of Germany | 96/50 A |

OTHER PUBLICATIONS

Journal of the SMPTE, "Ion-Exchange Recovery of Eastman Color Developers" by Priesthoff and Stott, Sep. 1956, vol. 65, pp. 478–484.

*Primary Examiner*—Mary F. Kelley
*Attorney, Agent, or Firm*—Connolly & Hutz

[57] ABSTRACT

A new process for the regeneration of spent color developers using both an ion exchanger and certain adsorbents is described. This process preserves the capacity of the exchanger to be regenerated.

5 Claims, No Drawings

REGENERATION OF SPENT COLOR DEVELOPERS

This invention relates to a process for the regeneration of spent colour developers which have been used for the colour development of photographic materials containing at least one silver halide emulsion layer.

In order to regenerate spent photographic baths, the substances which have been used up in these baths or removed from them in the course of processing photographic materials must be added to the spent colour developer. However, in order to regenerate spent colour developers it is not sufficient to replace the volume of solution which has been removed and add the spent substances (e.g. colour developer substance); in addition, the bromide ions which are released in the process of development of the photographic material must be removed from the colour developer. If a colour developer were repeatedly regenerated without the bromide ion concentration being reduced, this concentration would continuously increase and eventually impair the sensitometric properties of the photographic material until the material became unusable. It is already known that bromide ions can be removed from solutions by means of strongly basic anion exchangers.

One very serious disadvantage of regenerating spent colour developers with the aid of these anion exchangers is that the regeneration of the anion exchanger is substantially impaired after the passage of only a relatively small volume of spent colour developer through it so that the anion exchanger finally becomes incapable of removing bromide ions from the spent colour developer.

It is an object of the present invention to provide a process for the regeneration of spent colour developers by which the undesirably high bromide ion concentration can be reduced with the aid of an anion exchanger but the capacity of the ion exchanger to be regenerated and exchange bromide ions is preserved. It is another object of this invention to remove developer oxidation products and heavy metal ions from the spent colour developer.

It has now been found that certain substances, hereinafter referred to as adsorbents, e.g. adsorption resins, active charcoal, surface-modified active charcoal and Fuller's earth, are capable of preserving the capacity of the anion exchanger to be regenerated and to exchange bromide ions if the spent colour developer is passed through the adsorbent before it is passed through the anion exchanger. It is found that the developer substances are held back to differing extents by the different adsorbents. It has also surprisingly been found that among these adsorbents, adsorption resins such as phenol formaldehyde resins having hydroxyl groups or alkylated amino groups as functional groups (e.g. those described in "Duolite S 37 (Trademark)", O.T.S. 0090 F, June 1975, by the Diaprosim Company, of 94 400 Vituy, France) are adsorbing developer substances only in insignificant amounts but are particularly efficient in preserving the capacity for regeneration and for bromide ion exchange of the anion exchangers in the process according to the invention.

The anion exchangers used are preferably strongly basic exchangers, particularly those based on polystyrene or polystyrene/divinyl benzene and having, for example, a dimethyl ethanol ammonium group or a trimethylammonium group as the exchange active group. for example as described in German Pat. No. 1,054,715.

The process according to the invention for regenerating spent colour developers by using an anion exchanger preceded by an adsorbent may advantageously be supplemented by the additional use of a cation exchanger for removing from the solution the heavy metal ions present in the spent colour developer.

The combination according to the invention of adsorbent and anion exchanger for regenerating spent colour developers may be arranged in various ways. For example, the developer which overflows in the course of processing of the photographic material due to the addition of fresh chemicals may be collected and passed through the adsorbent and through the anion exchanger in that order from above downwards. After its passage through the adsorbent and exchanger, the spent developer may then be collected and mixed with the regenerator or, which is the same, the rejuvenator and then used as replenisher.

Regeneration of the anion exchanger is carried out after a certain quantity of spent coupler developer has passed through it, depending on the volume of anion exchanger used. The anion exchanger may be regenerated many times in the process according to the invention. It may be advantageous not to regenerate the adsorption resin used as adsorber but to discard it when it has been exhausted.

If a cation exchanger is used in addition for removing heavy metal ions, it may be arranged before, between or after the adsorbent and the anion exchanger. Since as a general rule only very small quantities of heavy metal ions are formed, it may be advisable to discard the cation exchanger rather than to regenerate it when it is exhausted.

The process according to the invention for the regeneration of spent colour developers is particularly advantageously employed for the regeneration of developers which contain a developer substance represented by the following general formula:

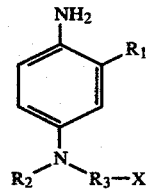

wherein $R_1$=H or alkyl, $R_2$=alkyl, $R_3$=alkylen, and

X=H, OH, alkoxy, $SO_3H$ or $NH—SO_2—R_2$.

The process according to the invention for the regeneration of spent colour developers may, of course, also be carried out on colour developers for any negative, positive or reversal processes.

The inventive will now be explained in more detail with the aid of the following Examples but is not restricted to them.

EXAMPLE 1

A colour paper developer having the composition indicated below is used for processing commercial colour paper and is then regenerated as described. The colour paper has the following arrangement of layers on a polyethylene laminated paper support:

Cyan layer, comprising a silver halide emulsion which is sensitized to the red spectral region, and a hydrophilic colour coupler for cyan Intermediate layer of gelatine Magenta layer, comprising a silver halide emulsion which is sensitized to the green spectral region, and a hydrophilic colour coupler for magenta Intermediate layer of gelatine Yellow layer, comprising a silver halide emulsion which is sensitive to the blue spectral region, and a hydrophilic colour coupler for yellow. Protective layer of gelatine

| Colour paper developer | |
|---|---|
| Hydroxylamine sulphate | 2 g/l |
| N'-Butyl-N'-ω-sulphobutyl-p-phenylenediamine | 4 g/l |
| Potassium carbonate | 60 g/l |
| Sodium sulphite | 3 g/l |
| Potassium bromide | 0.9 g/l |
| Sodium nitrilotriacetate | 3 g/l |

In order that the tank overflow may be used again as replenisher, it is advantageously first passed through the adsorbent and anion exchanger in order to reduce the bromide ion concentration in accordance with the invention. In the present case, the bromide ion concentration is preferably reduced to 0.7 g/l. The rate of replenishment is then fixed at 750 ml per $m^2$ of colour paper used. The bromide ion concentration of the tank overflow may, of course, equally well be reduced to other values.

The adsorbent used in an adsorption resin having a phenol formaldehyde matrix and containing alkylated amino groups as exchange active groups (Duolite S 37—Trade Mark). The anion exchanger is an exchanger according to German Pat. No. 1,054,715 in which the matrix is a copolymer of styrene and divinylbenzene and the exchange active groups are dimethylethanolammonium groups. 500 ml of the anion exchange resin are introduced into a column and covered with a column containing 10 ml of adsorbent. The developer overflow is passed through the two columns from above, i.e. first through the adsorbent and then through the anion exchange resin, at the rate of 4 liters per hour. The solution which has passed through the two columns is collected and regenerator is added thereto. To 1 liter developer passed through the columns a regenerator of the following composition is added in the quantities indicated:

Hydroxylamine Sulphate: 0.8 g

N'-butyl-N'-ω-sulphobutyl-p-phenylene-diamine: 1.5 g

Sodium sulphite: 0.5 g

Sodium hydroxide: 1 g

To equalize the loss of volume caused by carrying over 120 ml water per 1 liter developer passed through the columns are added. Addition of the regenerator to prepare the replenisher ready for use may be carried out either batchwise or continuously on the solution which has passed through the columns.

The replenisher thus obtained, which is ready for use, has the following compositions per liter:

Hydroxylamine sulphate: 2.5 g

N'-butyl-N'-ω-sulphobutyl-p-phenylene-diamine: 5 g

Potassium carbonate: 60 g

Sodium sulphite: 3.5 g

Potassium bromide: 0.7 g

Sodium hydroxide: 3 g

Sodium nitrilotriacetate: 3 g.

When approximately 45 liters of spent developer have passed through the columns, the quantity of anion exchanger put into the process is exhausted but can easily be regenerated as follows:

10 liters of 10% NaCl solution are run through the column which is filled with anion exchanger, followed by 5 liters of water. The anion exchanger is then completely regenerated and can be used again in a fresh regeneration cycle. The data given in Table 1 show that in this way the capacity for exchanging bromide ions is ensured in every cycle.

The quantity of adsorbent put into the process is exhausted when approximately 180 liters of spent colour developer have passed through it. Although the adsorbent could also be regenerated, it is simplest to discard it and replace it by fresh adsorption resin.

EXAMPLE 2 (COMPARATIVE)

The spent colour developer described in Example 1 is regenerated as indicated in Example 1 but without the use of an adsorbent before the anion exchanger. It is found that the bromide ion concentration of the solution which has passed through the anion exchanger increases after only the second cycle in spite of the steps taken to regenerate the ion exchanger, and that after the third cycle the anion exchanger no longer retains bromide ions. The anion exchanger obviously loses its capacity to be regenerated and retain bromide ions (see Table 1).

Table 1

Bromide ion concentration (in the form of KBr) in the anion exchanger eluate.

| | KBr (g/l) after | | | | |
|---|---|---|---|---|---|
| Example | 1st cycle | 2nd cycle | 3rd cycle | 10th cycle | 11th cycle |
| 1 (with adsorbent) | 0.7 | 0.7 | 0.7 | 0.7 | 0.7 |
| 2 (without adsorbent) | 0.7 | 0.8 | 0.9 | >0.9 | |

EXAMPLE 3

A colour paper developer having the composition indicated below is used for processing commercial colour paper and is then regenerated as described.

The colour paper has the following arrangement of layers on a polyethylene laminated paper support:

Cyan layer, comprising a silver halide emulsion which is sensitized to the red spectral region, and a hydrophobic colour-coupler for cyan.

Intermediate layer of gelatine

Magenta layer, comprising a silver-halide emulsion which is sensitized to the green spectral region, and a hydrophobic colour coupler for magenta UV-protective layer Yellow layer, comprising a silver-halide emulsion which is sensitive to the blue spectral region, and a hydrophobic colour coupler for yellow.

Protective layer of gelatine

| Colour paper developer | |
|---|---|
| Benzyl alcohol | 5 ml/l |
| Hydroxylamine sulphate | 3 g/l |
| 2-Amino-5-(N-ethyl-N-β-methanesulphonamidoethyl)-toluene | 5 g/l |
| Potassium carbonate | 35 g/l |
| Sodium sulphite | 3 g/l |
| Potassium bromide | 0.7 g/l |
| Sodium nitrilotriacetate | 3 g/l |

In order that the tank overflow may be used again as replenisher, it is advantageously first passed through the adsorbent and anion exchanger in order to reduce the bromide ion concentration in accordance with the invention. In the present case, the bromide ion concentration is preferably reduced to 0.35 g/l. The rate of replenishment is then fixed at 650 ml per $m^2$ of colour paper used. The bromide ion concentration of the tank overflow may, of course, equally well be reduced to other values.

The adsorbent used is an adsorption resin having a phenol formaldehyde matrix and containing alkylated amino groups as exchange active groups (Duolite S 37—Trade Mark). The anion exchanger is an exchanger according to German Pat. No. 1,054,715 in which the matrix is a copolymer of styrene and divinylbenzene and the exchange active groups are dimethylethanolammonium groups. 500 ml of the anion exchange resin are introduced into a column and covered with a column containing 100 ml of adsorbent. The developer overflow is passed through the two columns from above, i.e. first through the adsorbent and then through the anion exchange resin, at the rate of 4 liters per hour. The solution which has passed through the two columns is collected and regenerator is added thereto. To 1 liter developer passed through the columns a regenerator of the following composition is added in the quantities indicated:

Benzyl alcohol: 2 ml
Hydroxylamine Sulphate: 0.8 g
2-Amino-5-(N-ethyl-N-β-methanesulphonamidoethyl)-toluene: 2 g
Potassium carbonate: 5 g
Sodium sulphite: 0.5 g
Sodium hydroxide: 1 g To equalize the loss of volume caused by carrying over 120 ml water per 1 liter developer passed through the columns are added. Addition of the regenerator to prepare the replenisher ready for use may be carried out either batchwise or continuously on the solution which has passed through the columns.

The replenisher thus obtained, which is ready for use, has the following composition per liter:

Benzyl alcohol: 5 ml
Hydroxylamine Sulphate: 3.7 g
2-Amino-5-(N-ethyl-N-β-methanesulphonamidoethyl)-toluene: 6 g
Potassium carbonate: 35 g
Sodium sulphite: 3 g
Potassium bromide: 0.35 g
Sodium hydroxide: 3 g
Sodium nitrilotriacetate: 3 g When approximately 25 liters of spent developer have passed through the columns, the quantity of anion exchanger put into the process is exhausted but can easily be regenerated as follows:

10 liters of 5% NaOH solution are run through the column which is filled with anion exchanger, followed by 5 liters of water. The anion exchanger is then completely regenerated and can be used again in a fresh regeneration cycle. The data given in Table 2 show that in this way the capacity for exchanging bromide ions is ensured in every cycle.

The quantity of absorbent put into the process is exhausted when approximately 180 liters of spent colour developer have passed through it. Although the adsorbent could also be regenerated, it is simplest to discard it and replace it by fresh adsorption resin.

EXAMPLE 4 (COMPARATIVE)

The spent colour developer described in Example 3 is regenerated as indicated in Example 3 but without the use of an adsorbent before the anion exchanger. It is found that the bromide ion concentration of the solution which has passed through the anion exchanger increases after only the second cycle in spite of the steps taken to regenerate the ion exchanger, and that after the third cycle the anion exchanger no longer retains bromide ions. The anion exchanger obviously loses its capacity to be regenerated and retain bromide ions (see Table 2).

Table 2

Bromide ion concentration (in the form of KBr) in the anion exchanger eluate.

| | KBr (g/l) after | | | | |
|---|---|---|---|---|---|
| Example | 1st cycle | 2nd cycle | 3rd cycle | 10th cycle | 11th cycle |
| 3 (with adsorbent) | 0.35 | 0.35 | 0.35 | 0.35 | 0.35 |
| 4 (without adsorbent) | 0.35 | 0.6 | 0.7 | >0.7 | |

We claim:

1. A process for the regeneration of a spent color developer solution which has been used for the color development of photographic materials containing at least one silver halide emulsion layer
including the steps of
first contacting a spent color developer solution containing bromide ions with an adsorbent selected from the group consisting of adsorption resins, active charcoal, surface-modified active charcoal, and Fuller's earths,
and then contacting said spent color developer solution with an anion exchanger to remove bromide ions, and subsequently treating said anion exchanger to improve the bromide ion removable capability of said anion exchanger.

2. A process according to claim 1 wherein the colour developer solution is passed through a cation exchanger in addition to its treatment with the adsorbent and the anion exchanger.

3. A process according to claim 1 wherein the adsorption resins are phenol formaldehyde resins containing hydroxyl groups or secondary or tertiary amino groups.

4. A process according to claim 1 wherein the anion exchanger is a strongly basic anion exchanger.

5. A process according to claim 1 wherein the anion exchanger is a strongly basic anion exchanger and the adsorbent used is a phenol formaldehyde resin.

* * * * *